United States Patent [19]

Schmidt et al.

[11] Patent Number: 4,561,366

[45] Date of Patent: Dec. 31, 1985

[54] APPARATUS FOR HOLDING A CUT SEGMENT OF A SELECTED LENGTH

[76] Inventors: Volker Schmidt, 4638 Todds Rd., Lexington, Ky. 40509; Erich A. Schmidt, 2415 Liberty Rd., Lexington, Ky. 40505

[21] Appl. No.: 589,494

[22] Filed: Mar. 13, 1984

[51] Int. Cl.[4] ..... D05B 3/12; D05B 35/00

[52] U.S. Cl. ..... 112/121.27; 112/104

[58] Field of Search ..... 112/121.27, 121.26, 112/104, 152, 130; 83/409, 412, 415, 277; 414/749, 751; 269/56

[56] References Cited

U.S. PATENT DOCUMENTS

| | | | |
|---|---|---|---|
| 3,699,907 | 10/1972 | Anderson et al. | 112/104 X |
| 3,777,684 | 12/1973 | Friedman et al. | 112/121.27 X |
| 3,792,672 | 2/1974 | Friedman et al. | 112/104 |
| 3,841,247 | 10/1974 | Off et al. | 112/121.27 |
| 3,949,688 | 4/1976 | Andersson | 112/121.27 X |
| 4,114,544 | 9/1978 | Miyachi et al. | 112/121.27 X |
| 4,137,857 | 2/1979 | Miyachi et al. | 112/121.27 X |
| 4,287,842 | 9/1981 | Breck, Jr. | 112/121.27 |
| 4,348,924 | 9/1982 | Jenkner | 414/751 |
| 4,389,957 | 6/1983 | Block et al. | 112/104 X |
| 4,393,800 | 7/1983 | Hargett | 112/104 X |
| 4,502,399 | 3/1985 | Seaman | 112/121.27 |

*Primary Examiner*—Werner H. Schroeder
*Assistant Examiner*—Andrew M. Falik
*Attorney, Agent, or Firm*—Frank C. Leach, Jr.

[57] ABSTRACT

A cut segment of a strip of material is clamped intermediate its ends, prior to being cut, by two separate clamping elements. In one embodiment, one of the clamping elements is cammed towards the other clamping element as the clamping elements are moved to position the cut segment at a position for attachment to other material by a sewing machine, for example. This forms a loop or slack portion between the clamped portions of the cut segment so that attachment of the free ends of the cut segment produces a large loop when each end of the cut segment is attached to the other material. In another embodiment, one of the ends of the cut segment may be folded to form an overlapped portion for attachment to the other material so that a double thickness of the cut segment is attached to the other material. This embodiment still has one of the separate clamping elements movable towards the other to form a loop or slack portion between the clamped portions of the cut segment. In a further embodiment, each end of the cut segments can be folded to form an overlapped portion so that it can be attached with double thickness to the other material. In this embodiment, the two separate clamping elements remain fixed as to their distance between each other so that no loop or slack portion can be formed therebetween by camming one of the separate clamping elements towards the other.

19 Claims, 16 Drawing Figures

APPARATUS FOR HOLDING A CUT SEGMENT OF A SELECTED LENGTH

This invention relates to an apparatus for holding a segment cut from a strip of material intermediate its free ends at two spaced portions of the strip and, more particularly, to an apparatus for producing a loop or slack portion between two clamped portions of a cut segment of a strip of material intermediate its free ends when desired.

In our copending patent application for "Apparatus For Forming Cut Segments Of A Selected Length With At Least One Folded End," Ser. No. 462,032, filed Jan. 28, 1983, which is incorporated by reference herein, there is shown an apparatus for forming cut segments of a selected length with the cut segment being held intermediate its ends prior to disposition of the cut segment at a sewing machine where the cut segment is attached to other material by the sewing machine. Each free end of the cut segment can be folded by rotating a pair of arms so that a double thickness of each end of the cut segment is attached to the other material. As discussed in our aforesaid application, the cut segment with one or both ends folded is stitched to an article of clothing such as pants, for example, so that the cut segment with one or both ends folded functions as a belt loop.

The present invention is an improvement of the apparatus of our aforesaid application in that the folded ends can be formed in a non-tension condition with the apparatus of the present invention. In our aforesaid application, the folded ends were formed under tension because of the single holding clamp intermediate the free ends of the cut segment. With certain stretch materials, this arrangement is not always satisfactory.

The apparatus of the present invention is capable of folding one or both ends of the cut segment in a non-tension condition. Thus, a stretch material will not change its length when having one or both ends folded by the apparatus of the present invention as may occur with the apparatus of our aforesaid application.

Furthermore, in forming belt loops on pants, it is sometimes desired to sew the ends of the cut segment directly to the pants without an overlapping or folded relation at either end of the cut segment. At the same time, it is desired to be able to fold over one or both ends of the cut segment after it has been sewn to the pants. This requires the cut segment to have a loop or slack portion intermediate its ends at the time that it is initially sewn to the pants.

The apparatus of the present invention satisfactorily solves this problem through forming a cut segment with a loop or slack portion between two clamped portions of the cut segment. With this arrangement, the free ends of the cut segment are attached to the other material such as pants, for example. This results in the loop or slack portion being between the sewn ends of the cut segment. Then, when one or both ends of the material is folded over to form a completed belt loop so that no stitches will be visible, the slack or loop portion of the cut segment enables the belt loop to fit smoothly against the pants, for example.

The apparatus of the present invention is capable of having one of the free ends folded while still having the slack or loop portion formed in the cut segment. Therefore, when the cut segment is used as a belt loop for pants, the folded end of the cut segment could be sewn to the pants to function as the lower portion of the belt loop with the other end of the cut segment being sewn to the pants to function as the upper end of the belt loop. Then, the folding over of the material forming the pants with the upper end of the belt loop would enable the belt loop to be finished without any showing of the stitches at the upper end of the belt loop.

The appatatus of the present invention is capable of forming a belt loop of any selected length with the slack or loop portion of the cut segment being adjustable as to its size. Therefore, the user is able to obtain a cut segment of a selected length with a selected amount of loop or slack therein for attachment to other material such as a pair of pants with the cut segment functioning as a belt loop.

An object of this invention is to provide an apparatus for cutting a segment of a selected length from a strip of material with a loop or slack portion of a selected length being formed between the ends of the cut segment.

Another object of this invention is to provide an apparatus for forming a belt loop with an initial loop or slack portion between its sewed ends.

A further object of this invention is to provide an apparatus in which a slack or loop portion may be formed between the clamped intermediate portions of a cut segment of a selected length and one end of the cut segment may, if desired, be folded.

Still another object of this invention is to provide an apparatus for forming cut segments of a selected length with the cut segments being capable of being formed with one or both ends folded or being formed with a slack or loop portion of a selected length between clamped intermediate portions of the cut segment with the option of one end of the cut segment being folded.

A still further object of this invention is to provide an apparatus in which the user may shift between forming one or both ends of a cut segment of a selected length with a fold or forming a slack or loop portion of a selected length between clamped intermediate portions of the cut segment with only one end folded or neither end folded.

Yet another object of this invention is to provide an apparatus for forming one or both ends of a cut segment of a selected length with a fold without any tension on any folded portion.

Other objects of this invention will be readily perceived from the following description, claims, and drawings.

This invention relates to an apparatus for holding a cut segment of a selected length and forming a loop in the cut segment including support means and two separate clamping means supported by the support means for movement with the support means to clamp separate portions of a strip of material to be cut before cutting or when the strip of material is cut to produce a cut segment of a selected length. The two separate clamping means clamp the separate portions of the strip of material intermediate the ends of the cut segment to be produced from the strip of material. Means mounts the support means for reciprocating movement along a path substantially orthogonal to the strip of material that is to be cut to produce the cut segment to be clamped by the two separate clamping means. Means causes reciprocating movement of the support means along the path from a first position at which the cut segment is produced from the strip of material by cutting and the two separate clamping means clamp the cut segment to a second position at which the cut segment is to be attached to other material by the cut segment being retained for attachment to the other material prior to the two separate clamping means ceasing to clamp the cut segment, from the second position to a third position more remote from the second position than the first position to enable positioning of the strip of material prior to the two separate clamping means being positioned for clamping separate portions of the strip of material, and from the third position to the first position. Reducing means reduces the distance between the two separate clamping means at least from where the two separate clamping means clamp the cut segment and before the support means is disposed at the second position so that the cut segment has a loop of a selected length formed between the two separate clamping means when the support means is at the second position.

This invention also relates to an apparatus for holding a cut segment of a selected length for attachment to other material including support means supporting two separate clamping means for movement with the support means to clamp separate portions of a strip of material to be cut before cutting or when the strip of material is cut to produce a cut segment of a selected length. The two separate clamping means clamp the separate portions of the strip of material intermediate the ends of the cut segment to be produced from the strip of material. Means mounts the support means for reciprocating movement along a path substantially orthogonal to the strip of material that is to be cut to produce the cut segment to be clamped by the two separate clamping means. Means causes reciprocating movement of the support means along the path from a first position at which the cut segment is produced from the strip of material by cutting and the two separate clamping means clamp the cut segment to a second position at which the cut segment is to be attached to other material by the cut segment being retained for attachment to the other material prior to the two separate clamping means ceasing to clamp the cut segment, from the second position to a third position more remote from the second position than the first position to enable positioning of the strip of material prior to the two separate clamping means being positioned for clamping separate portions of the strip of material, and from the third position to the first position. Means adjustably mounts each of the two separate clamping means on the support means to change the distance between the two separate clamping means.

This invention further relates to an apparatus for holding a cut segment of a selected length and folding its ends including support means supporting two separate clamping means for movement with the support means to clamp separate portions of a strip of material to be cut before cutting or when the strip of material is cut to produce a cut segment of a selected length. The two separate clamping means clamp the separate portions of the strip of material intermediate the ends of the cut segment to be produced from the strip of material. Means mounts the support means for reciprocating movement along a path substantially orthogonal to the strip of material that is to be cut to produce the cut segment to be clamped by the two separate clamping means. Means causes reciprocating movement of the support means along the path from a first position at which the cut segment is produced from the strip of material by cutting and the two separate clamping means clamp the cut segment to a second position at which the cut segment is to be attached to other material by the cut segment being retained for attachment to the other material prior to the two separate clamping means ceasing to clamp the cut segment, from the second position to a third position more remote from the second position than the first position to enable positioning of the strip of material prior to the two separate clamping means being positioned for clamping separate portions of the strip of material, and from the third position to the first position. First folding means, which is disposed closer to where the cut segment is cut than either of the two separate clamping means, is supported by the support means to fold one end of the cut segment clamped by the two separate clamping means after the strip of material has been cut to produce the cut segment. Second folding means is supported by the support means to fold the other end of the cut segment clamped by the two separate clamping means after the strip of material has been cut to produce the cut segment with the second folding means being supported by the support means further from where the cut segment is cut than either of the two separate clamping means.

Figure 1:
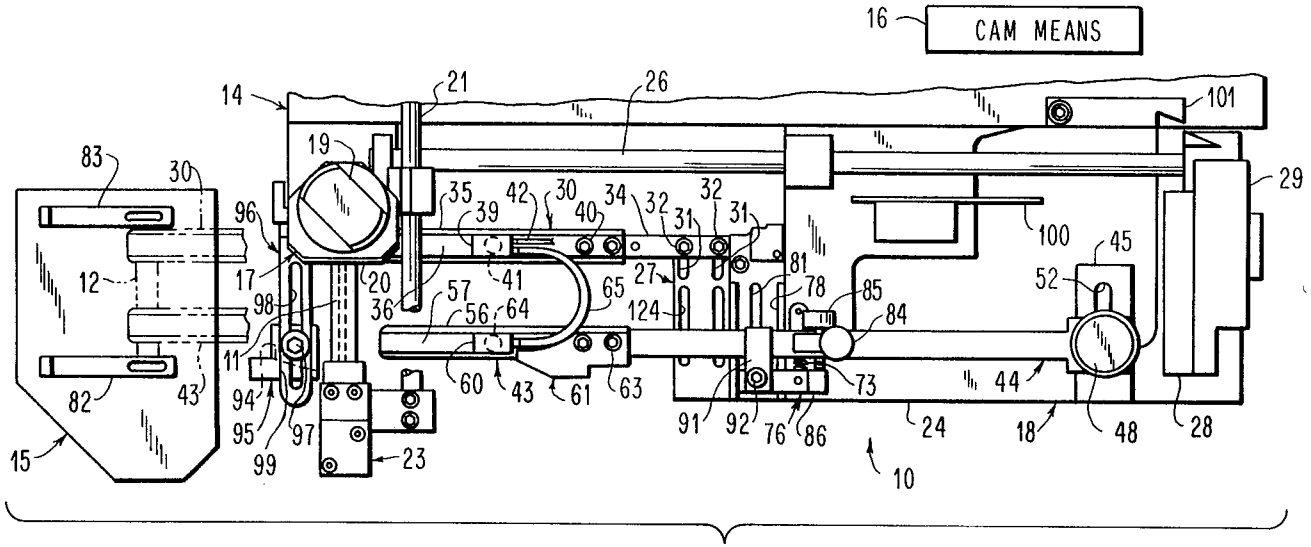
FIG. 1 is a top plan view of one embodiment of the apparatus of the present invention.

Referring to the drawings and particularly FIG. 1, there is shown an apparatus 10, which is substantially the same as that shown in our aforesaid application incorporated by reference herein, for cutting a strip 11

Figure 12:
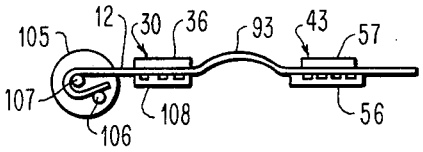
FIG. 12 is a fragmentary end elevational view of a portion of the apparatus of FIG. 11 and showing the cut segment with a loop or slack portion formed intermediate its clamped portions and with one of its ends folded.
Figure 14:
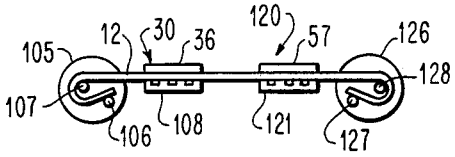
FIG. 14 is a fragmentary end elevational view of a portion of the apparatus of FIG. 13 and showing the cut segment with both of its ends folded.

(The dotted lines on the strip 11 in FIG. 1 identify threads attaching turned portions of the material to form the strip 11.) of material into cut segments 12 (see FIG. 10) of a selected length. The cut segment 12 also may be formed with a loop or slack portion intermediate its ends to function as a belt loop, for example. As shown in FIG. 12, one end of each of the cut segments 12 may be folded to form a belt loop, for example, with a loop or slack portion intermediate its ends. As shown in FIG. 14, both ends of the cut segment 12 may be folded to form a belt loop, for example, without any loop or slack portion intermediate its ends.

The strip 11 (see FIG. 1) of material may be formed, for example, by having separate portions sewed to each other at their overlapping ends. Each of the separate portions would be cut from a layer of material to be used as a pair of pants so that the belt loops from each separate portion would be sewed to the pants of the same layer of material.

The apparatus 10 includes a horizontal support platform 14. The platform 14 is supported on a table (not shown) in the manner shown and described in our aforesaid application.

In the same manner as shown and described in our aforesaid application, each cycle of operation of the apparatus 10 begins with an operator at a sewing machine 15 closing a switch to energize an electric motor to rotate through 360°. The motor rotates a cam shaft having single cam means 16 (schematically shown in FIG. 1) thereon for controlling each cycle of operation of the apparatus 10.

As shown and described in our aforesaid application, the cam means 16 controls the feeding of the strip 11 of material past cutting means 17 and across the path of reciprocating movement of a frame 18, which is slidably supported by the platform 14. The amount of feed of the strip 11 of material past the cutting means 17 during each cycle of operation is controlled in the manner shown and described in our aforesaid application with the strip 11 of material being fed a first selected distance past the cutting means 17 and then a second selected distance.

As shown and described in our aforesaid application, the cutting means 17 includes an air cylinder 19 for moving an upper movable blade relative to a lower fixed blade when the air cylinder 19 is activated. The air cylinder 19 is supported on the upper end of a vertical extending frame 20, which is mounted on the platform 14. The frame 20 also slidably supports the upper movable blade and supports the lower fixed blade as shown and described in our aforesaid application.

The feeding of the strip 11 of material past the cutting means 17 is produced by movement of a horizontally disposed rod 21 along its longitudinal axis during each cycle of operation as shown and described in our aforesaid application. Thus, the retraction of the rod 21 causes the strip 11 of material to be fed the first selected distance past the cutting means 17.

At the completion of retraction of the rod 21, the strip 11 of material has its free end extending beyond the plane of the cutting blades of the cutting means 17 and disposed between a pair of jaws of a gripper 23, which is mounted on the end of the rod 21. When the free end of the strip 11 of material is gripped between the jaws of the gripper 23 in the manner shown and described in our aforesaid application, the rod 21 is moved towards the front of the platform 14 to cause the strip 11 of material to be pulled past the cutting means 17 the second selected distance so that the sum of the first and second selected distances is equal to the selected length of the strip 11 of material to be cut by the cutting means 17. The gripper 23 remains in this position during the remainder of a cycle of operation.

The reciprocating motion of the frame 18 along its path, which is substantially orthogonal to the path along which the strip 11 of material is pulled by the gripper 23, is controlled by the single cam means 16 in the manner shown and described in our aforesaid application. The frame 18 includes a plate 24 having linkage means connected thereto and controlled by the single cam means 16 in the manner shown and described in our aforesaid application.

The frame 18 including the plate 24 is mounted for sliding movement along guide rods (one shown at 26). The guide rods (one shown at 26) are supported by the platform 14 in the manner shown and described in our aforesaid application.

The plate 24 of the frame 18 has a block 27 attached to its forward end and two blocks 28 and 29 attached to its rear end. The blocks 28 and 29 are the same as those shown and described in our aforesaid application.

The block 27 has first clamping means 30 supported thereon for adjustable movement towards and away from the cutting means 17. The first clamping means 30 clamps the strip 11 of material prior to it being cut by the cutting means 17 in such a manner that the first clamping means 30 clamps the cut segment 12 (see FIG. 10) intermediate its ends when the cut segment 12 is produced by the cutting means 17 (see FIG. 1) cutting the strip 11 of material.

Figure 3:
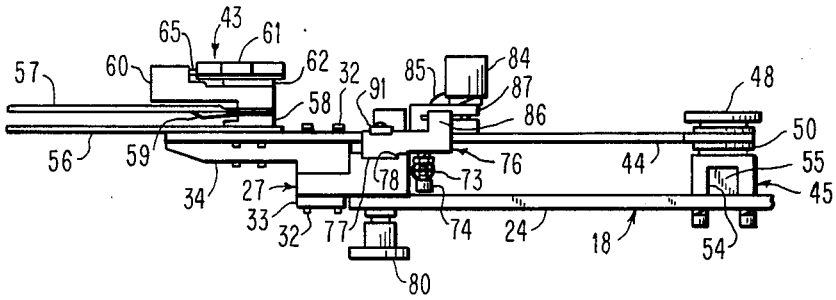
FIG. 3 is a left side elevational view of a portion of the apparatus of FIG. 1.

The block 27 has a first pair of parallel elongated slots 31 therein to receive Allen screws 32 for cooperation with a retaining nut 33 (see FIG. 3) to attach a mounting arm 34 (see FIG. 1) to the block 27. This arrangement enables the mounting arm 34 to be moved to adjust the position of the first clamping means 30, which is mounted on the mounting arm 34, relative to the cutting means 17.

Figure 4:
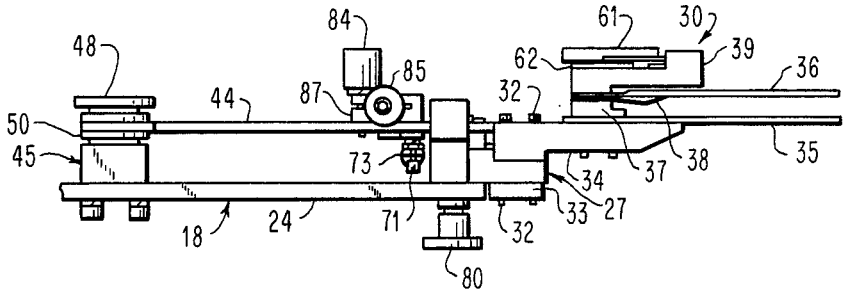
FIG. 4 is a right side elevational view of a portion of the apparatus of FIG. 1.

The first clamping means 30 includes a lower finger 35 resting on the upper surface of the mounting arm 34 and an upper finger 36 disposed in spaced relation to the lower finger 35 by a spacer 37 (see FIG. 4). A spring 38 rests on the upper surface of the spacer 37 and acts against the bottom surface of the upper finger 36 to urge the upper finger 36 away from the lower finger 35.

A piston block 39 is mounted on top of the upper finger 36 and supported by the spacer 37. The piston block 39, the upper finger 36, the spring 38, the spacer 37, and the lower finger 35 are mounted on the mounting arm 34 by a pair of screws 40 (see FIG. 1).

The piston block 39 has a piston 41 movable therein to act on the upper finger 36 and overcome the force of the spring 38 (see FIG. 4) to move the upper finger 36 towards the lower finger 35 when pressurized air is supplied through a hose 42 (see FIG. 1) from a pressurized air source in the manner shown and described in our aforesaid application. This clamps a portion of the strip 11 of material between the fingers 35 and 36, which are positioned at this time on opposite sides of the strip 11 of material.

The frame 18 also supports second clamping means 43 for clamping the strip 11 of material at the same time that the first clamping means 30 clamps the strip 11 of material. The second clamping means 43 also clamps the strip 11 of material in such a manner that the second clamping means 43 clamps the cut segment 12 (see FIG.

10) intermediate its ends when the cut segment 12 is produced by the cutting means 17 (see FIG. 1) cutting the strip 11 of material.

Figure 7:
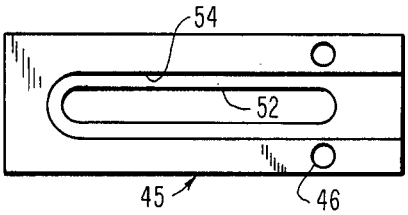
FIG. 7 is a bottom plan view of a block of the apparatus of FIG. 1 for supporting one end of the support arm of FIG. 6.

The second clamping means 43 is mounted on an adjustable support arm 44, which has one end pivotally mounted on a block 45. The block 45 is supported on the plate 24 of the frame 18 by screws, which extend through threaded openings 46 (see FIG. 7) in the block 45 and similar threaded openings 47 (see FIG. 13) in the plate 24 of the frame 18.

Figure 5:
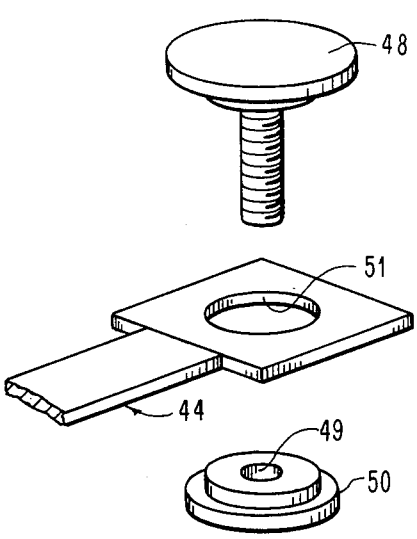
FIG. 5 is an exploded perspective view of a portion of the support arm of the pivot structure of the apparatus of FIG. 1.

The support arm 44 (see FIG. 1) is adjustably positioned on the block 45 through having a handscrew 48 extend through an opening 49 (see FIG. 5) in a bushing 50, which has a portion mounted in an opening 51 in the support arm 44. The handscrew 48 (see FIG. 1) has its threaded stem extend through an elongated slot 52 in the block 45.

Figure 2:
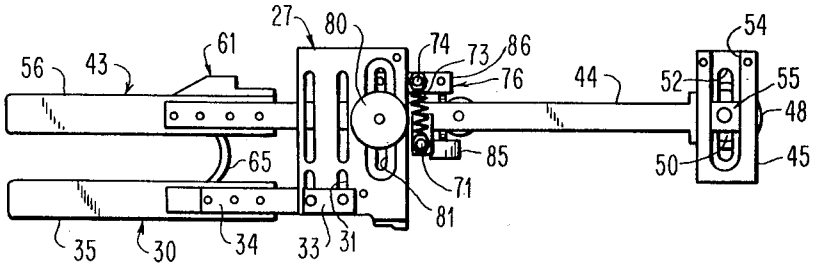
FIG. 2 is a bottom plan view of a portion of the apparatus of FIG. 1 with some parts removed for clarity to show two clamping means.

The bottom of the block 45 has an enlarged, elongated slot 54 (see FIG. 7) formed therein beneath the elongated slot 52 and extending to one side of the block 45 to enable reception of a square nut 55 (see FIG. 2) therein. The square nut 55 receives the threaded stem of the handscrew 48 (see FIG. 1) to lock the support arm 44 in any adjustable position along the length of the elongated slot 52 in the block 45. At the same time, the support arm 44 can pivot about the center of the handscrew 48.

The second clamping means 43 is mounted on the free end of the support arm 44. The second clamping means 43 includes a lower finger 56 resting on the upper surface of the support arm 44 and an upper finger 57 disposed in spaced relation to the lower finger 56 by a spacer 58 (see FIG. 3). A spring 59 rests on the upper surface of the spacer 58 and acts against the bottom surface of the upper finger 57 to urge the upper finger 57 away from the lower finger 56. A piston block 60 is mounted on top of the upper finger 57 and supported by the spacer 58.

A cam follower 61 is disposed above the portion of the piston block 60 mounted above the spacer 58 and maintained at a desired vertical level by a shim 62. The lower finger 56, the spacer 58, the upper finger 57, the spring 59, the piston block 60, the shim 62, and the cam follower 61 are attached to the support arm 44 by a pair of screws 63 (see FIG. 1).

Figure 9:
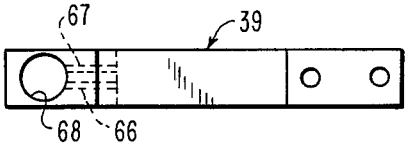
FIG. 9 is a bottom plan view of a piston block of one of the clamping means of the apparatus of FIG. 1.

A piston 64 is movable in the piston block 60 to act on the upper finger 57 to overcome the force of the spring 59 (see FIG. 3) and move the upper finger 57 towards the lower finger when pressurized air is supplied through a hose 65 (see FIG. 1) from the piston block 39. As shown in FIG. 9, the piston block 39 has two passages 66 and 67 therein communicating with a cylinder 68 in the piston block 39 for the piston 41 (see FIG. 1) so that the air supplied through the hose 42 from the pressurized source also is supplied to the hose 65. Thus, both the first clamping means 30 and the second clamping means 43 are simultaneously activated when pressurized air is supplied through the hose 42 from the pressurized air source.

Figure 6:
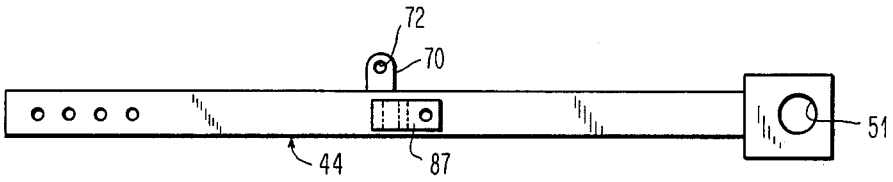
FIG. 6 is a top plan view of a support arm for supporting one of the clamping means of the apparatus of FIG. 1.
Figure 8:
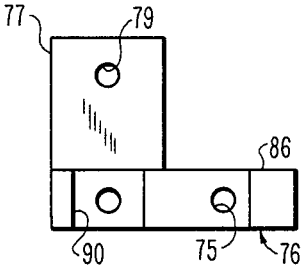
FIG. 8 is a top plan view of another block utilized with the support arm of FIG. 6 intermediate its ends.

The support arm 44 has an ear 70 (see FIG. 6) intermediate its end to receive a screw 71 (see FIG. 2) in a threaded opening 72 (see FIG. 6) of the ear 70. The screw 71 (see FIG. 2) has one end of a spring 73 secured thereto with the other end of the spring 73 attached to a screw 74 extending into a threaded opening 75 (see FIG. 8) in a block 76.

The block 76 has a bottom portion 77 (see FIG. 3) slidable in a guide groove 78 (see FIG. 1) in the block 27. The bottom portion 77 (see FIG. 8) has a threaded opening 79 to receive a handscrew 80 (see FIG. 2), which extends through an elongated slot 81 (see FIG. 1) in the block 27 from the bottom of the block 27.

Thus, the position of the block 76 in the block 27 is adjustable to adjust the position of the second clamping means 43 relative to the first clamping means 30. Therefore, the release of the handscrew 80 (see FIG. 2) enables the adjustment of the second clamping means 43 (see FIG. 1) towards or away from the first clamping means 30 through moving the block 76 in the guide groove 78 in the block 27. This enables adjustment of the second clamping means 43 relative to a presser foot 82 of the sewing machine 15. The sewing machine 15 has a second presser foot 83 spaced from the presser foot 82 in the same manner as shown and described in our aforesaid application.

To insure that the support arm 44 is parallel to the front of the apparatus 10, a further adjustment is obtained through releasing a handscrew 84. This enables a handscrew 85 to be moved towards or away from an upstanding portion 86 of the block 76 against which the end of the handscrew 85 engages. The spring 73 (see FIG. 2) urges the handscrew 85 against the upstanding portion 86 of the block 76 so that the handscrew 85 functions as a stop for the support arm 44. The handscrew 85 enables finite adjustment of the second clamping means 43.

The handscrew 85 extends through a bifurcated portion 87 (see FIG. 3) on the upper surface of the support arm 44. The handscrew 84 tightens the upper portion of the bifurcated portion 87 against the lower portion to lock the handscrew 85 in any position to which it is adjusted.

The upper surface of the block 76 has a groove 90 (see FIG. 8) formed therein to receive a finger 91 (see FIG. 1), which overlies the support arm 44. The finger 91 is secured to the block 76 by a screw 92.

The location of the first clamping means 30 relative to the cutting means 17 is determined by the position of the Allen screws 32 in the elongated slots 31 in the block 27. The retaining nut 33 (see FIG. 2) cooperates with the Allen screws 32 (see FIG. 1) to hold the first clamping means 30 in the desired position on the block 27.

Figure 16:
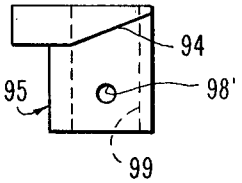
FIG. 16 is a bottom plan view of a cam used with the apparatus of FIG. 1.

During movement of the frame 18 towards the sewing machine 15 by the cam means 16 in the manner shown and described in our aforesaid application, a loop or slack portion 93 (see FIG. 10) is formed in the cut segment 12 by movement of the second clamping means 43 towards the first clamping means 30 through the cam follower 61 (see FIG. 1) on the second clamping means 43 cooperating with a surface 94 (see FIG. 16) of a cam 95, which is adjustably mounted on a cam bracket 96 (see FIG. 1). The cam bracket 96 is retained on the frame 20 of the cutting means 17.

The cam 95 is adjustably positioned on the cam bracket 96 through a screw 97 extending through an elongated slot 98 in the cam bracket 96 and into a threaded opening 98' (see FIG. 16) in the cam 95. The cam 95 has a groove 99 in its upper surface to be slidably mounted on the cam bracket 96 (see FIG. 1). Therefore, loosening of the screw 97 enables movement of the cam 95 along the cam bracket 96 to the desired position. The screw 97 is then tightened to retain the cam 95 in the desired position.

The adjustment of the position of the cam 95 on the cam bracket 96 determines the selected length of the loop or slack portion 93 (see FIG. 10) of the cut segment 12. A further finite adjustment of the length of the loop or slack portion 93 of the cut segment 12 is obtained by the handscrew 85 (see FIG. 1).

Considering the operation of the apparatus of the present invention, a cycle of operation begins with an operator at the sewing machine 15 closing a switch to start a cycle of operation of the motor as shown and described in our aforesaid application. Each cycle of operation is one revolution of the motor as shown and described in our aforesaid application.

At the start of a cycle of operation, the cut segment 12 (see FIG. 10), which has already been cut, is retained between the fingers 35 and 36 of the first clamping means 30 and the fingers 56 and 57 of the second clamping means 43 with the frame 18 (see FIG. 1) to the left of the position shown in FIG. 1. As the frame 18 is moved to the left in FIG. 1 during the cycle of operation, the retained cut segment 12 is positioned beneath the presser feet 82 and 83 and on top of the material, which rests on a sewing plate of the sewing machine 15, to which the retained cut segment 12 is to be sewed by a needle in the manner shown and described in our aforesaid application.

This movement of the frame 18 to the left in FIG. 1 causes the cam follower 61 to engage the surface 94 (see FIG. 16) of the cam 95 to move the second clamping means 43 (see FIG. 1) towards the first clamping means 30 to produce the loop or slack portion 93 (see FIG. 10) of the selected length in the cut segment 12. When the frame 18 has completed its movement to the left in FIG. 1, the presser feet 82 and 83 clamp the retained cut segment 12 to the sewing plate of the sewing machine 15 to hold the retained cut segment 12 on top of the material to which the retained cut segment 12 is to be sewed by the needle of the sewing machine 15 as shown and described in our aforesaid application.

When the frame 18 has completed its movement to the left in FIG. 1, a switch is closed by engagement by the block 28 on the frame 18 as shown and described in our aforesaid application. This causes release of the fingers 35 and 36 of the first clamping means 30 and the fingers 56 and 57 of the second clamping means 43 from clamping engagement with the cut segment 12. It also lifts the upper cutting blade of the cutting means 17 upwardly from the lower fixed cutting blade as shown and described in our aforesaid application.

Thus, the movement of the presser feet 82 and 83 into engagement with the material is substantially simultaneous with the release of the fingers 35 and 36 of the first clamping means 30 and the fingers 56 and 57 of the second clamping means 43 from clamping engagement with the cut segment 12. However, there is a slight time delay before the frame 18 begins to retract from the sewing machine 15 in the manner shown and described in our aforesaid application. Withdrawal of the fingers 35 and 36 of the first clamping means 30 and the fingers 56 and 57 of the second clamping means 43 from the cut segment 12 occurs prior to any sewing since sewing is delayed until a plate 100 on the plate 24 of the frame 18 engages a switch during retraction of the frame 18 as shown and described in our aforesaid application.

Retraction of the frame 18 to the right in FIG. 1 continues until the frame 18 reaches the position of FIG. 1. At this time, the cam means 16 causes the strip 11 of material to be fed a first selected distance past the cutting plane of the cutting blades of the cutting means 17 as shown and described in our aforesaid application.

Upon completion of feeding of the strip 11 of material the first selected distance, the jaws of the gripper 23 are positioned as shown and described in our aforesaid application to grip the free ends of the strip 11 of material and pull the strip 11 of material across the travel path of the frame 18. Then, the frame 18 is advanced from the position of FIG. 1 towards the left by the cam means 16 as shown and described in our aforesaid application. The movement of the frame 18 to the left of the position of FIG. 1 is to a position in which the fingers 35 and 36 of the first clamping means 30 and the fingers 56 and 57 of the second clamping means 43 are disposed on opposite sides of the portion of the strip 11 extending between the cutting means 17 and the gripper 23.

With the frame 18 so positioned, the cam means 16 causes pressurized air to be supplied through the hose 42 from the pressurized air source to move the upper finger 36 towards the lower finger 35 and the upper finger 57 towards the lower finger 56 to clamp the strip 11 of material intermediate the ends of the cut segment 12 to be cut from the strip 11 of material. As shown and described in our aforesaid application, pressurized air also is supplied to the upper end of the air cylinder 19 of the cutting means 17 and pressurized air is removed from the lower end of the air cylinder 19 so as to cause the movable upper cutting blade of the cutting means 17 to move downwardly into cutting engagement with the strip 11 of material through cooperation with the fixed cutting blade of the cutting means 17.

Figure 10:
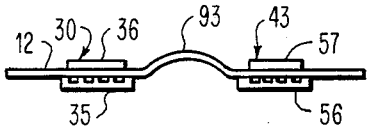
FIG. 10 is a fragmentary end elevational view of a portion of the apparatus of FIG. 1 and showing the cut segment clamped to form a loop or slack portion intermediate its clamped portions.

Therefore, when the strip 11 of material is being cut by the cutting means 17, the strip 11 of material is retained or held between the fingers 35 and 36 of the first clamping means 30 and between the fingers 56 and 57 of the second clamping means 43. Accordingly, the cut segment 12 produced by the cutting means 17 is retained between the fingers 35 and 36 of the first clamping means 30 and the fingers 56 and 57 of the second clamping means 43. As shown in FIG. 10, one end of the cut segment 12 is disposed beyond the fingers 35 and 36 of the first clamping means 30 and the other end of the cut segment 12 is disposed beyond the fingers 56 and 57 of the second clamping means 43. This enables the ends of the cut segment 12 to be engaged by the presser feet 82 (see FIG. 1) and 83 when the cut segment 12 is disposed beneath the presser feet 82 and 83.

After the cut segment 12 has been cut from the strip 11 of material and retained between the fingers 35 (see FIG. 10) and 36 of the first clamping means 30 and the fingers 56 and 57 of the second clamping means 43, the cam means 16 (see FIG. 1) opens a switch to inactivate the motor to complete a cycle of operation as shown and described in our aforesaid application. If the thickness of the portion of the strip 11 of material to be cut exceeded a predetermined thickness so that the cut segment 12 was not to be used, another cycle of operation automatically occurs so that one of the cut segments 12 not exceeding the predetermined thickness will be retained between the fingers 35 and 36 of the first clamping means 30 and the fingers 56 and 57 of the second clamping means 43 at the end of a cycle of operation.

Furthermore, during the cycle of operation begun by the operator at the sewing machine 15 closing the switch, the frame 18 cannot be advanced to the left in FIG. 1 from the position to which it is retracted if the portion of the strip 11 of material to be cut has a thickness exceeding the predetermined thickness. The advancement of the frame 18 to the left in FIG. 1 from the position of FIG. 1 is prevented by a latch 101 being moved into a position to block advancement of the frame 18 to the left in FIG. 1 as shown and described in our aforesaid application. Thus, when the thickness of the portion of the strip 11 of material cut by the cutting means 17 exceeds the predetermined thickness, the cut segment 12 is not retained by the first clamping means 30 and the second clamping means 43 because of the frame 18 being retained in the position of FIG. 1 by the latch 101.

During the next cycle of operation that automatically occurs without the operator at the sewing machine 15 having to close the switch, the latch 101 is removed from blocking the advancement of the frame 18 to the left in FIG. 1 if the portion of the strip 11 of material to be cut has a thickness that does not exceed the predetermined thickness. This results in a cycle of operation occurring to produce the cut segment 12 for holding by the first clamping means 30 and the second clamping means 43.

Figure 11:
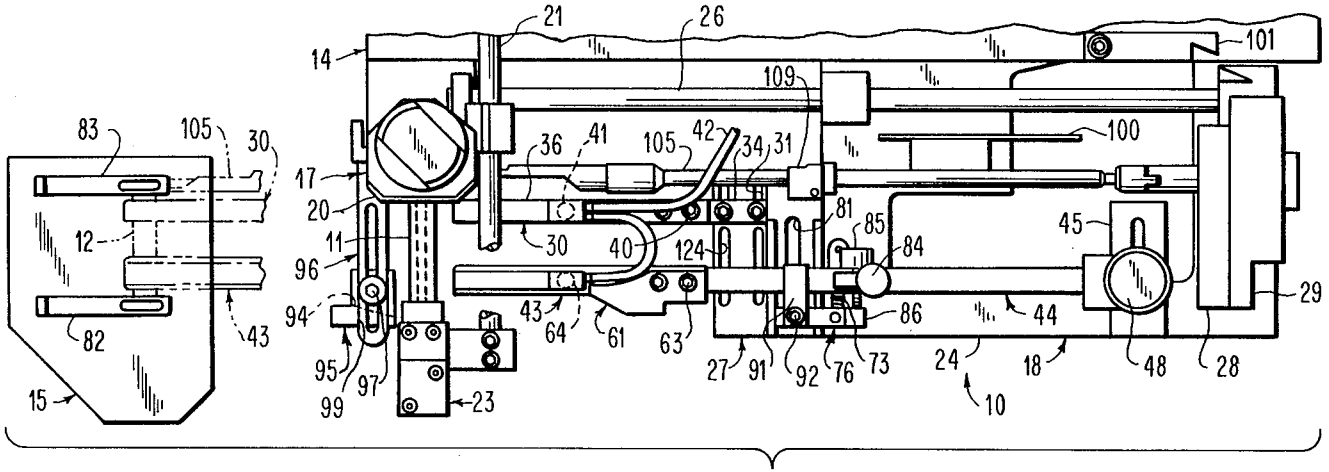
FIG. 11 is a top plan view of a modification of the apparatus of FIG. 1 in which one end of the cut segment is folded.

Referring to FIG. 11, there is shown another embodiment of the present invention in which one end of the cut segment 12 is to be folded. The first clamping means 30 is positioned closer to the second clamping means 43 in this embodiment than in the embodiment of FIG. 1. This enables positioning of an arm 105 on the frame 18 with a pair of fold pins 106 (see FIG. 12) and 107 mounted thereon at its free end. While the pins 106 and 107 are shown circular in cross section, it should be understood that they may have other sectional shapes and that they do not have to have the same sectional shape.

Because of the presence of the arm 105, the first clamping means 30 has the lower finger 35 (see FIG. 10), which is wider than the upper finger 36, replaced by a lower finger 108 (see FIG. 12), which is the same width as the upper finger 36. The remainder of the first clamping means 30 is the same as in the embodiment of FIG. 1.

Accordingly, when the frame 18 is advanced to the left in FIG. 11 to have the strip 11 of material enter between the fingers 36 (see FIG. 12) and 108 of the first clamping means 30 and the fingers 56 and 57 of the second clamping means 43, the strip 11 (see FIG. 11) of material also enters between the pins 106 (see FIG. 12) and 107 of the arm 105. After the strip 11 (see FIG. 11) of material is cut and the gripper 23 ceases to grip the end of the strip 11 of material, the arm 105 is rotated more than 180° but less than 270°, as shown and described in our aforesaid application, to wrap one end of the cut segment 12 (see FIG. 12) around the pin 107 to form one end of the cut segment 12 with a folded end.

The arm 105 extends through a bearing block 109 (see FIG. 11) of the block 27 and the block 28 into the block 29. The end of the arm 105 has a shaft (not shown) with two pinion gears (not shown) thereon witnin the block 29 with one of the pinion gears cooperating with a rack (not shown) within the block 29 as shown and described in our aforesaid application.

As shown and described in our aforesaid application, the arm 105 is rotated when pressurized air is supplied to an air cylinder, which is supported by the block 29, to move the rack within the block 29 in one direction to rotate the arm 105 to fold the one end of the cut segment 12. After folding of the end of the cut segment 12 has been completed, the cam means 16 (see FIG. 1) causes inactivation of the motor to stop a cycle of operation with the cut segment 12 (see FIG. 12) having its one end folded around the pin 107 and retained between the fingers 36 and 108 of the first clamping means 30 and the fingers 56 and 57 of the second clamping means 43.

Because the cut segment 12 is held by the first clamping means 30 and the second clamping means 43, there is not a tight winding of the end of the cut segment 12 around the pin 107. Thus, the folded end of the cut segment 12 is not under tension.

The operation of the embodiment of FIG. 11 is the same as that described for the embodiment of FIG. 1 in which the arm 105 was not present except for the rotation of the arm 105. With this embodiment, the cam means 16 (see FIG. 1) causes rotation of the arm 105 (see FIG. 11) after the cut segment 12 has been cut from the strip 11 of material with this rotation being greater than 180°. This is just prior to the cam means 16 (see FIG. 1) inactivating the motor to stop the cycle of operation as shown and described in our aforesaid application.

Furthermore, as shown and described in our aforesaid application, when the frame 18 is retracted to the position of FIG. 11, the arm 105 (see FIG. 12) is rotated in the opposite direction. This returns the pins 106 and 107 to the position in which they can receive the strip 11 (see FIG. 11) of material therebetween when the frame 18 is advanced to the left from the position of FIG. 11.

In this embodiment, the second clamping means 43 can still be movable relative to the first clamping means 30 by the cam follower 61 moving along the cam surface 94 (see FIG. 16) of the cam 95 to form the loop 93 (see FIG. 12) in the cut segment 12 intermediate its ends when desired. This movement of the second clamping means 43 towards the first clamping means 30 occurs during movement of the frame 18 (see FIG. 11) to position the cut segment 12 at the sewing machine 15 in the same manner as described for the embodiment of FIG. 1.

Figure 13:
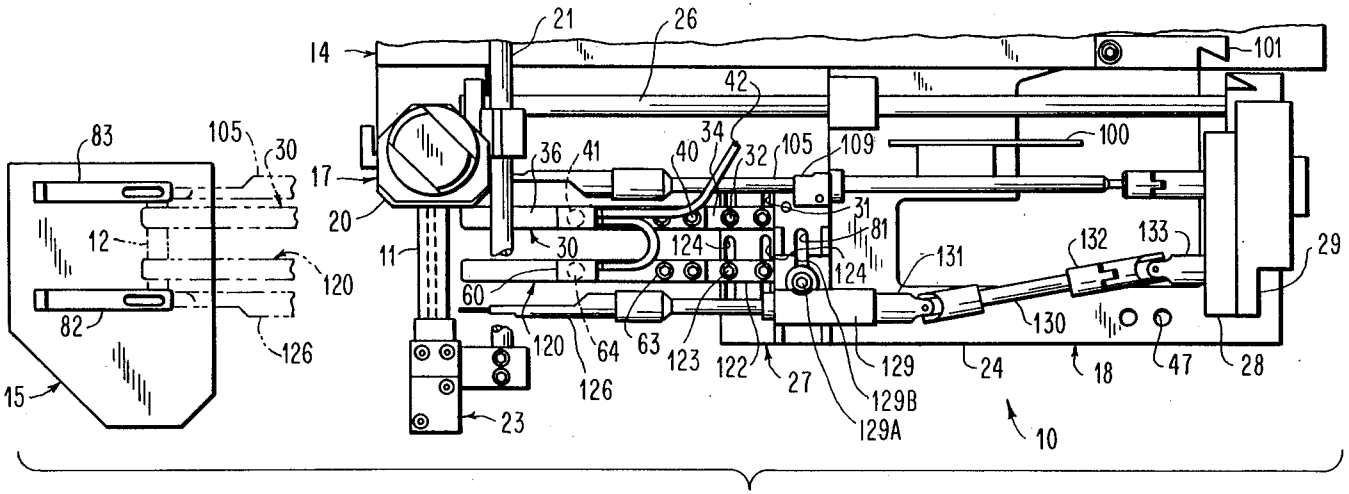
FIG. 13 is a top plan view of a further modification of the apparatus of FIG. 1 in which both ends of the cut segment are folded.

Referring to FIG. 13, there is shown another arrangement of the present invention in which both ends of the cut segment 12 are folded or looped. In this modification, no loop can be formed between the ends of the cut segment 12 (see FIG. 14).

In FIG. 13, the first clamping means 30 is the same as in FIG. 11. Second clamping means 120 (see FIG. 13) is utilized instead of the second clamping means 43 of FIG. 11. The second clamping means 120 (see FIG. 13) does not include the cam follower 61 (see FIG. 3) or the shim 62. The second clamping means 120 (see FIG. 14) has a lower finger 121 instead of the lower finger 56 (see FIG. 10) of the second clamping means 43. The lower finger 121 (see FIG. 14) is the same width as the upper finger 57. The second clamping means 120 also includes the spacer 58 (see FIG. 3), the spring 59, and the piston block 60 of the second clamping means 43.

Figure 15:
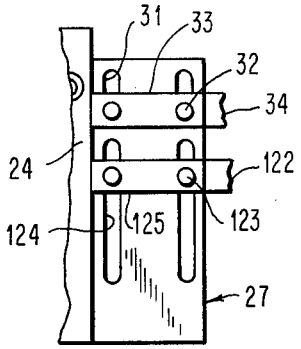
FIG. 15 is a fragmentary bottom plan view of a portion of the apparatus of FIG. 13.

The second clamping means 120 (see FIG. 13) is mounted on a mounting arm 122, which is the same as the mounting arm 34. The mounting arm 122 is attached to the block 27 through Allen screws 123 extending through a pair of parallel elongated slots 124 in the block 27 and cooperating with a retaining nut 125 (see FIG. 15), which is the same as the retaining nut 33 (see FIG. 2).

While the position of the second clamping means 120 (see FIG. 13) relative to the first clamping means 30 is adjustable, there is a limit to which the second clamping means 120 can be disposed away from the first clamping means 30 because of the presence of an arm 126. The arm 126, which is substantially parallel to the arm 105, has a pair of fold pins 127 (see FIG. 14) and 128 mounted at its free end. While the pins 127 and 128 are shown circular in cross section, it should be understood that the pins 127 and 128 may have other sectional shapes and that the pins 127 and 128 do not have to have the same sectional shape.

The pins 127 and 128 have the strip 11 (see FIG. 13) of material enter therebetween at the same time that the strip 11 of material enters between the pins 106 (see FIG. 14) and 107 on the arm 105, the fingers 36 and 108 of the first clamping means 30, and the fingers 57 and 121 of the second clamping means 120 as described relative to the embodiment of FIG. 11.

The arm 126 (see FIG. 14) is rotated the same amount as the arm 105 but in the opposite direction. This wraps the two ends of the cut segment 12 about the pins 107 and 128 to form the ends of the cut segment 12 as folded or looped ends. Because of the clamping by the first clamping means 30 and the second clamping means 120 at spaced portions of the cut segment 12, there is no tension on the cut segment 12 when it is wound around the pins 107 and 128.

The arm 126 extends through a block 129 (see FIG. 13), which is adjustably mounted on the block 27 to enable the arm 126 to be adjustable relative to the arm 105 to accommodate various lengths of the cut segment 12. A screw 129A extends through a slot 129B in the block 129 and the slot 81 in the block 27 and cooperates with a nut (not shown) to lock the block 129 in the desired adjustable position.

As shown and described in our aforesaid application, the arm 126 is connected to one end of a connecting arm 130 by a universal joint 131. The other end of the arm 130 is connected by a universal joint 132 to an arm 133, which extends into the blocks 28 and 29.

As shown and described in our aforesaid application, the arm 133 has a pinion gear (not shown) thereon for cooperation with the pinion gear on the shaft on the arm 105 not cooperating with the rack in the block 29 so that the arm 126 is rotated at the same time and the same speed as the arm 105 but in the opposite direction. The rotation of the arms 105 and 126 in opposite directions folds the ends of the cut segment 12 (see FIG. 14) to form the looped ends so that the cut segment 12 may function as a belt loop.

The arms 105 and 126 are rotated when pressurized air is supplied to the air cylinder, which is supported by the block 29 (see FIG. 13), to move the rack in one direction to rotate the arms 105 and 126 in opposite directions to fold the ends of the cut segment 12 (see FIG. 14). The supply of pressurized air is controlled by the cam means 16 (see FIG. 1) as shown and described in our aforesaid application.

The operation of this embodiment is the same as that described for the operation of the embodiment of FIG. 11 except that the second clamping means 120 is not moved towards the first clamping means 30 during movement of the frame 18 towards the sewing machine 15 as the second clamping means 43 (see FIG. 11) is moved towards the first clamping means 30 and there is rotation of the arms 105 (see FIG. 13) and 126 rather than just the arm 105 as in the embodiment of FIG. 11 since only the arm 105 is present in FIG. 11.

An advantage of this invention is that it reduces the amount of material required to be folded underneath either one end of the cut segment or both ends of the cut segment because the clamping means prevent the folded portions of the cut segment from slipping from their positions on fold pins. Another advantage of this invention is that a single apparatus can be employed with substitution of only a few parts for forming one or both ends of the cut segment folded and with a loop between the clamped portions of the cut segment when the cut segment has only one folded end or no folded end.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

We claim:

1. An apparatus for holding a cut segment of a selected length and forming a loop in the cut segment including:

support means;

two separate clamping means supported by said support means for movement with said support means to clamp separate portions of a strip of material to be cut before cutting or when the strip of material is cut to produce a cut segment of a selected length, said two separate clamping means clamping the separate portions of the strip of material intermediate the ends of the cut segment to be produced from the strip of material;

means to mount said support means for reciprocating movement along a path substantially orthogonal to the strip of material that is to be cut to produce the cut segment to be clamped by said two separate clamping means;

means to cause reciprocating movement of said support means along the path from a first position at which the cut segment is produced from the strip of material by cutting and said two separate clamping means clamp the cut segment to a second position at which the cut segment is to be attached to other material by the cut segment being retained for attachment to the other material prior to said two separate clamping means ceasing to clamp the cut segment, from the second position to a third position more remote from the second position than the first position to enable positioning of the strip of material prior to said two separate clamping means being positioned for clamping separate portions of the strip of material, and from the third position to the first position;

and reducing means to reduce the distance between said two separate clamping means at least from where said two separate clamping means clamp the cut segment and before said support means is disposed at the second position so that the cut segment has a loop of a selected length formed between said two separate clamping means when said support means is at the second position.

2. The apparatus according to claim 1 including:

pivot means to pivotally mount one of said two separate clamping means on said support means for pivotal movement towards and away from the other of said two separate clamping means to reduce the distance therebetween;

means to continuously urge said one clamping means away from said other clamping means to a selected position;

and said reducing means including moving means to move said one clamping means towards said other clamping means during movement of said support means from the first position to the second position so that the cut segment has a loop of a selected length formed between said two separate clamping means.

3. The apparatus according to claim 2 in which said moving means includes:

cam means;

and cam following means mounted on said one clamping means to cooperate with said cam means to cause movement of said one clamping means from the selected position towards said other clamping means during movement of said support means along the path from the first position to the second position.

4. The apparatus according to claim 2 including means to control the selected position of said one clamping means.

5. The apparatus according to claim 3 including means to adjustably position said cam means to control the amount of movement of said one clamping means from the selected position towards said other clamping means.

6. The apparatus according to claim 3 including:

first folding means supported by said support means to fold one end of the cut segment clamped by said two separate clamping means after the strip of material has been cut to produce the cut segment;

and said first folding means being disposed exterior of each of said two separate clamping means.

7. The apparatus according to claim 9 in which said first folding means is disposed closer to where the cut segment is cut from the strip of material than either of said two separate clamping means.

8. The apparatus according to claim 3 including means to control the selected position of said one clamping means.

9. The apparatus according to claim 4 including means to control the selected position of said one clamping means.

10. The apparatus according to claim 5 in which said control means includes:

a stop at a selected fixed position;

and adjustable means carried by said one clamping means for engaging said stop to control the selected position to which said one clamping means is urged by said urging means about said pivot means.

11. The apparatus according to claim 6 including:

first folding means supported by said support means to fold one end of the cut segment clamped by said two separate clamping means after the strip of material has been cut to produce the cut segment;

and said first folding means being disposed exterior of each of said two separate clamping means.

12. The apparatus according to claim 7 in which said first folding means is disposed closer to where the cut segment is cut from the strip of material than either of said two separate clamping means.

13. The apparatus according to claim 1 including:

first folding means supported by said support means to fold one end of the cut segment clamped by said two separate clamping means after the strip of material has been cut to produce the cut segment;

and said first folding means being disposed exterior of each of said two separate clamping means.

14. The apparatus according to claim 13 in which said first folding means is disposed closer to where the cut segment is cut from the strip of material than either of said two separate clamping means.

15. An apparatus for holding a cut segment of a selected length and folding its ends including:

support means;

two separate clamping means supported by said support means for movement with said support means to clamp separate portions of a strip of material to be cut before cutting or when the strip of material is cut to produce a cut segment of a selected length, said two separate clamping means clamping the separate portions of the strip of material intermediate the ends of the cut segment to be produced from the strip of material;

means to mount said support means for reciprocating movement along a path substantially orthogonal to the strip of material that is to be cut to produce the cut segment to be clamped by said two separate clamping means;

means to cause reciprocating movement of said support means along the path from a first position at which the cut segment is produced from the strip of material by cutting and said two separate clamping means clamp the cut segment to a second position at which the cut segment is to be attached to other material by the cut segment being retained for attachment to the other material prior to said two separate clamping means ceasing to clamp the cut segment, from the second position to a third position more remote from the second position than the first position to enable positioning of the strip of material prior to said two separate clamping means being positioned for clamping separate portions of the strip of material, and from the third position to the first position;

first folding means supported by said support means to fold one end of the cut segment clamped by said two separate clamping means after the strip of material has been cut to produce the cut segment;

said first folding means being disposed closer to where the cut segment is cut than either of said two separate clamping means;

second folding means supported by said support means to fold the other end of said cut segment clamped by said two separate clamping means after the strip of material has been cut to produce the cut segment;

and said second folding means being supported by said support means further from where the cut segment is cut than either of said two separate clamping means.

16. The apparatus according to claim 15 including means to change the distance between said two separate clamping means.

17. An apparatus for holding a cut segment of a selected length for attachment to other material including:

support means;

two separate clamping means supported by said support means for movement with said support means to clamp separate portions of a strip of material to be cut before cutting or when the strip of material is cut to produce a cut segment of a selected length, said two separate clamping means clamping the separate portions of the strip of material intermediate the ends of the cut segment to be produced from the strip of material;

means to mount said support means for reciprocating movement along a path substantially orthogonal to the strip of material that is to be cut to produce the cut segment to be clamped by said two separate clamping means;

means to cause reciprocating movement of said support means along the path from a first position at which the cut segment is produced from the strip of material by cutting and said two separate clamping means clamp the cut segment to a second position at which the cut segment is to be attached to other material by the cut segment being retained for attachment to the other material prior to said two separate clamping means ceasing to clamp the cut segment, from the second position to a third position more remote from the second position than the first position to enable positioning of the strip of material prior to said two separate clamping means being positioned for clamping separate portions of the strip of material, and from the third position to the first position;

and means to adjustably mount each of said two separate clamping means on said support means to change the distance between said two separate clamping means.

18. The apparatus according to claim 17 including:

at least one folding means supported by said support means to fold an end of the cut segment clamped by said two separate clamping means after the strip of material has been cut to produce the cut segment;

said one folding means being disposed exterior of each of said two separate clamping means;

and said adjustably mounting means including means to change the distance of said one folding means from each of said two separate clamping means.

19. The apparatus according to claim 18 including:

two separate folding means supported by said support means, one of said folding means being closer to where the cut segment is cut than either of said two separate clamping means and the other of said folding means being further from where the cut segment is cut than either of said two separate clamping means;

and means to adjustably mount said other folding means on said support means to change the distance of said other folding means from each of said two separate clamping means and said one folding means.

* * * * *

UNITED STATES PATENT AND TRADEMARK OFFICE

CERTIFICATE OF CORRECTION

PATENT NO. : 4,561,366

DATED : December 31, 1985

INVENTOR(S) : Volker Schmidt et al

It is certified that error appears in the above-identified patent and that said Letters Patent is hereby corrected as shown below:

In the Abstract, line 20, "segments" should read --- segment ---.

Column 7, line 49, after "finger" insert --- 56 ---.

Column 11, line 56, "witnin" should read --- within ---.

Column 15, line 27, "9" should read --- 6 ---.

Column 15, line 34, "4" should read --- 5 ---.

Column 15, line 37, "5" should read --- 9 ---.

Column 15, line 44, "6" should read --- 10 ---.

Column 15, line 51, "7" should read --- 11 ---.

Signed and Sealed this

*Twenty-second* Day of *April 1986*

[SEAL]

*Attest:*

DONALD J. QUIGG

*Attesting Officer*

*Commissioner of Patents and Trademarks*